US009352590B2

(12) United States Patent
Ota et al.

(10) Patent No.: US 9,352,590 B2
(45) Date of Patent: May 31, 2016

(54) IMAGE RECORDING APPARATUS

(71) Applicant: Brother Kogyo Kabushiki Kaisha, Nagoya-shi, Aichi-ken (JP)

(72) Inventors: Yasuhira Ota, Yatomi (JP); Iwane Sano, Obu (JP); Masao Mimoto, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/801,043

(22) Filed: Jul. 16, 2015

(65) Prior Publication Data

US 2015/0321491 A1 Nov. 12, 2015

Related U.S. Application Data

(62) Division of application No. 14/036,911, filed on Sep. 25, 2013, now Pat. No. 9,114,644.

(30) Foreign Application Priority Data

Sep. 28, 2012 (JP) ..... 2012-217541

(51) Int. Cl.
*B41J 29/38* (2006.01)
*B41J 11/04* (2006.01)
(Continued)

(52) U.S. Cl.
CPC *B41J 11/04* (2013.01); *B41J 13/03* (2013.01); *B41J 13/103* (2013.01); *B65H 3/0669* (2013.01); *B65H 3/0684* (2013.01); *B65H 5/062* (2013.01);
(Continued)

(58) Field of Classification Search
CPC ..... B41J 11/04; B41J 13/03; B41J 13/103; B65H 3/0669; B65H 3/0684; B65H 5/062; B65H 5/068; B65H 5/26; B65H 29/58
USPC ..... 347/16, 32, 104; 74/665 F, 665 G
See application file for complete search history.

(56) References Cited

U.S. PATENT DOCUMENTS 6,641,130 B2 11/2003 Lee et al.
7,464,922 B2 12/2008 Kozaki et al.
(Continued)

FOREIGN PATENT DOCUMENTS

JP H05-92838 A 4/1993
JP 2002060088 A 2/2002
JP 2006-082918 A 3/2006

OTHER PUBLICATIONS

Dec. 15, 2015—(JP) Notification of Reason for Refusal—App 2012-217541.

*Primary Examiner* — Henok Legesse
(74) *Attorney, Agent, or Firm* — Banner & Witcoff, Ltd.

(57) ABSTRACT

A sheet feeder, including: a sheet supply roller configured to supply a sheet to a sheet feeding path; a sheet feed roller configured to feed the sheet supplied to the sheet feeding path by the sheet supply roller to a downstream side in a sheet feeding direction in which the sheet is fed; a discharge roller configured to discharge the sheet fed by the feed roller to a downstream side in the sheet feeding direction; a drive motor configured to drive a first shaft for rotating the feed roller; a first transmitting mechanism configured to transmit a rotary motion of the first shaft to a second shaft for rotating the discharge roller; and a second transmitting mechanism configured to transmit a rotary motion of the second shaft to a third shaft for rotating the sheet supply roller.

4 Claims, 10 Drawing Sheets

(51) Int. Cl.

| | |
|---|---|
| ***B41J 13/03*** | (2006.01) |
| ***B65H 5/06*** | (2006.01) |
| ***B65H 5/26*** | (2006.01) |
| ***B65H 29/58*** | (2006.01) |
| ***B41J 13/10*** | (2006.01) |
| ***B65H 3/06*** | (2006.01) |

(52) U.S. Cl.
CPC ..... *B65H 5/068* (2013.01); *B65H 5/26* (2013.01); *B65H 29/58* (2013.01); *B65H 2402/46* (2013.01); *B65H 2403/20* (2013.01); *B65H 2403/42* (2013.01); *B65H 2403/722* (2013.01); *B65H 2553/51* (2013.01)

(56) References Cited

U.S. PATENT DOCUMENTS

| | | | |
|---|---|---|---|
| 2006/0071389 | A1 | 4/2006 | Kozaki et al. |
| 2007/0146463 | A1 | 6/2007 | Sasa |
| 2013/0044154 | A1 | 2/2013 | Terashima |

IMAGE RECORDING APPARATUS

CROSS REFERENCE TO RELATED APPLICATION

The present application is a divisional of and claims the benefit of pending U.S. application Ser. No. 14/036,911 filed Sep. 25, 2013 which is based on the Japanese Patent Application No. 2012-217541, filed on Sep. 28, 2012. The contents of each of the above documents are hereby incorporated by reference in their entirety.

BACKGROUND OF THE INVENTION

1. Field of the Invention

The present invention relates to a sheet feeder configured to feed a sheet while distributing a drive force of one drive source to a plurality of rollers. The invention further relates to an image recording apparatus equipped with such a sheet feeder.

2. Description of Related Art

There has been conventionally known an image recording apparatus in which one motor drives a plurality of driven portions such as rollers and a maintenance unit by distributing a drive force of the motor by a distributing mechanism.

For instance, there has been known a structure in which a transmission switching mechanism is configured to transmit a rotation of a registering-roller shaft connected to a sheet feed motor selectively to one of a first force transmitting unit configured to transmit a force to a first sheet supplying portion, a second force transmitting unit configured to transmit a force to a second sheet supplying portion, and a third force transmitting unit configured to transmit a force to a maintenance unit.

SUMMARY OF THE INVENTION

In the known structure in which the first through third force transmitting units are connected to the above-indicated registering-roller shaft so as to be parallel with one another, however, there may be a risk of concentration of a load on the registering-roller shaft, thereby adversely influencing sheet feeding by the registering roller fitted on the registering-roller shaft.

The present invention has been developed in the situations described above. It is therefore an object of the invention to provide a sheet feeder which distributes a load in a force transmission path and which ensures a simplified force transmitting mechanism and to provide an image recording apparatus equipped with the sheet feeder.

The object indicated above may be attained according to one aspect of the invention, which provides a sheet feeder including: a sheet supply roller configured to supply a sheet to a sheet feeding path; a sheet feed roller configured to feed the sheet supplied to the sheet feeding path by the sheet supply roller to a downstream side in a sheet feeding direction in which the sheet is fed; a discharge roller configured to discharge the sheet fed by the feed roller to a downstream side in the sheet feeding direction; a drive motor configured to drive a first shaft for rotating the feed roller; a first transmitting mechanism configured to transmit a rotation of the first shaft to a second shaft for rotating the discharge roller; and a second transmitting mechanism configured to transmit a rotation of the second shaft to a third shaft for rotating the sheet supply roller.

The object indicated above may be attained according to another aspect of the invention, which provides an image recording apparatus, including: a sheet supply roller configured to supply a sheet to a sheet feeding path; a sheet feed roller configured to feed the sheet supplied to the sheet feeding path by the sheet supply roller to a downstream side in a sheet feeding direction in which the sheet is fed; a discharge roller configured to discharge the sheet fed by the feed roller to a downstream side in the sheet feeding direction; a drive motor configured to drive a first shaft for rotating the feed roller; a first transmitting mechanism configured to transmit a rotary motion of the first shaft to a second shaft for rotating the discharge roller; a second transmitting mechanism configured to transmit a rotary motion of the second shaft to a third shaft for rotating the sheet supply roller; a carriage disposed between the feed roller and the discharge roller in the sheet feeding direction and configured to reciprocate in a width direction orthogonal to the sheet feeding direction; and a recording head mounted on the carriage and configured to eject ink from nozzles to the sheet that is being fed in the sheet feeding path.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which:

FIG. 4A shows a state in which the purging mechanism 70 is spaced apart from a carriage while FIG. 4B shows a state in which the purging mechanism 70 is in contact with the carriage;

FIG. 9A shows a first state while FIG. 9B shows a second state; FIG. 10A shows a third state while FIG. 10B shows a fourth state.

DETAILED DESCRIPTION OF THE EMBODIMENT

There will be hereinafter described one embodiment of the present invention. It is to be understood that the embodiment will be described for illustrative purpose only and that the invention may be embodied with various other changes and modifications, without departing from the scope of the invention defined in the attached claims. In the following description, an up-down direction 7 is defined on the basis of a state in which a multi-function peripheral (MFP) 10 is placed in its operative position (i.e., a state of the MFP 10 shown in FIG.

1), a front-rear direction 8 is defined by regarding, as a front side, a side of the MFP 10 on which an opening 13 is provided, and a left-right direction 9 is defined in a state in which the MFD 10 is seen from the front side.

<MFP 10>

Figure 1:
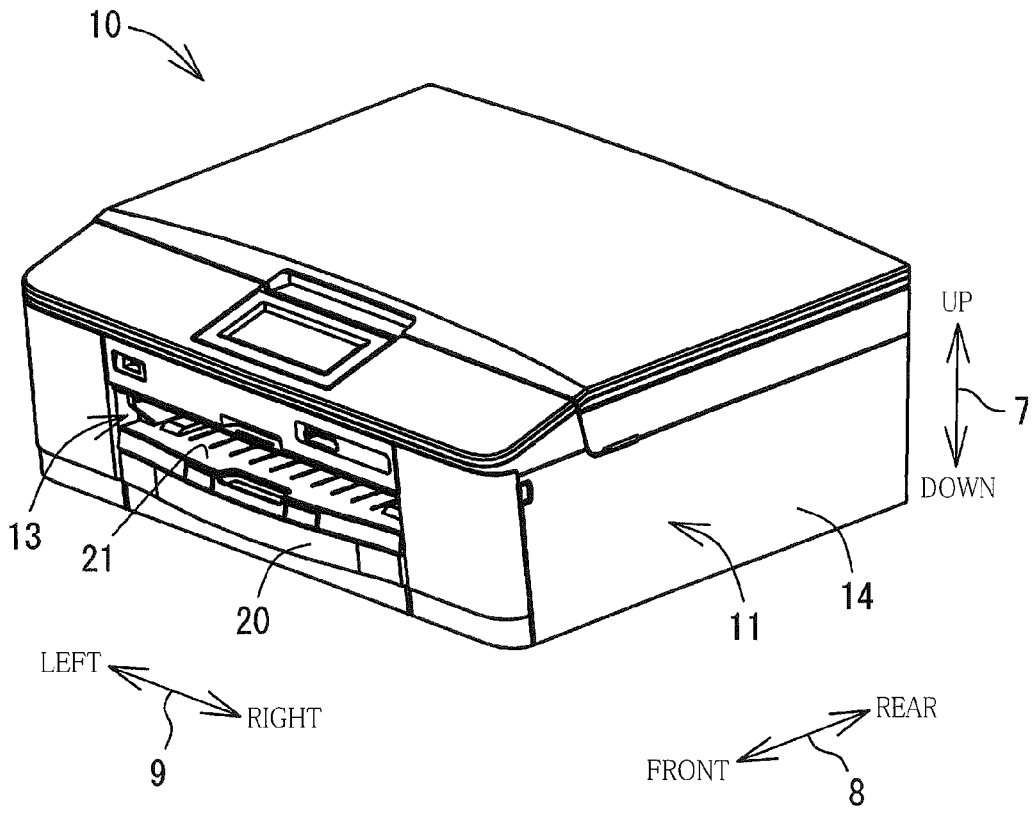
FIG. 1 is an external perspective view of an MFP 10 according to one embodiment of the invention.

As shown in FIG. 1, the MFP 10 (as one example of an image recording apparatus of the present invention) has a substantially rectangular parallelepiped shape with a low profile. The MFP 1 has, at its lower portion, a printer unit 11 of an ink-jet type. (The printer unit 11 may also be referred to as the printer 11 or the printer portion 11.) The MFP 10 has various functions such as a facsimile function and a printing function.

Figure 2:
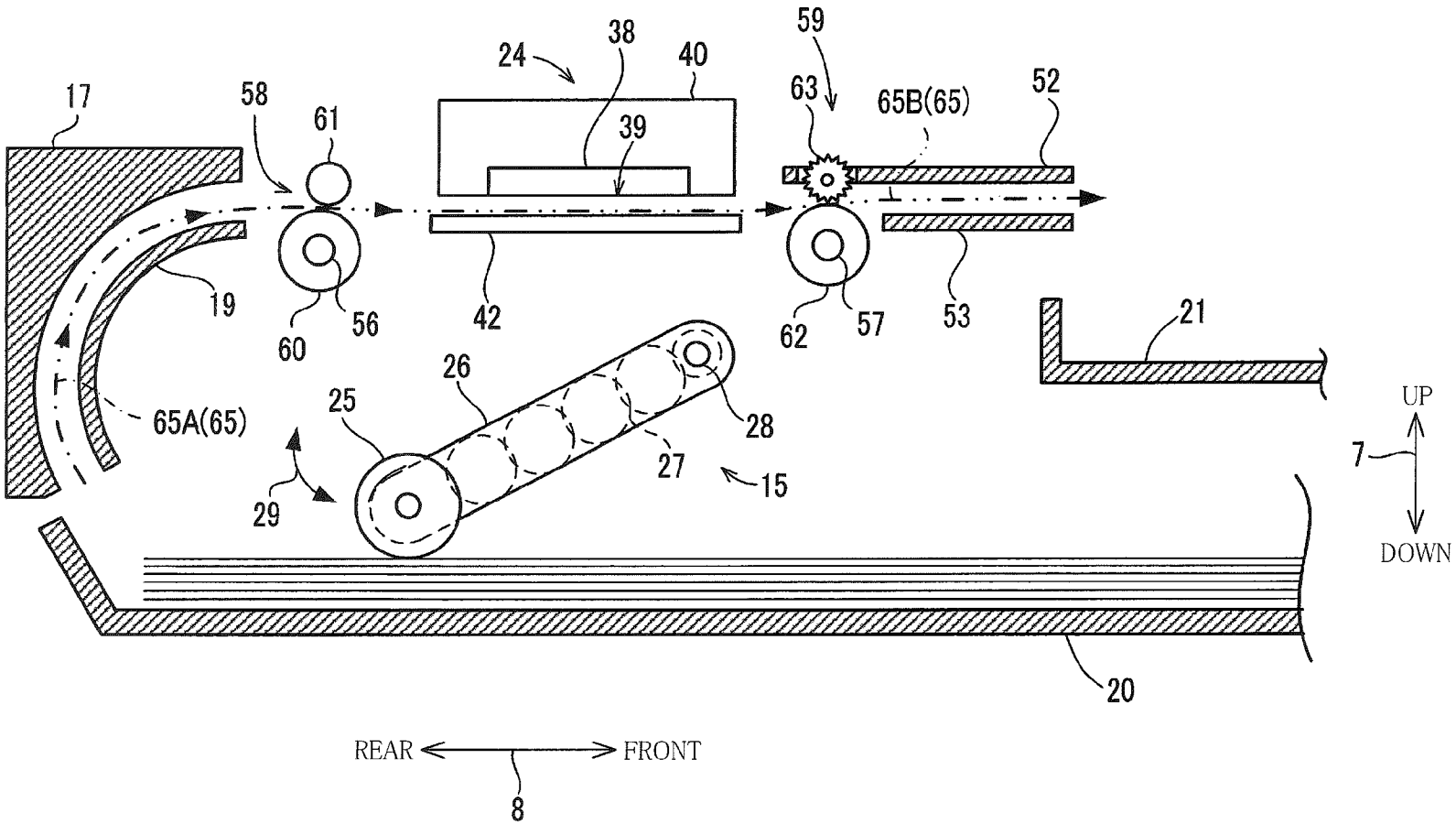
FIG. 2 is an elevational view in vertical cross section schematically showing an internal structure of a printer unit 11.

As shown in FIG. 1, the printer unit 11 has a casing 14 in which the opening 13 is formed so as to be open to a front surface of the casing 14. A sheet supply tray 20 (as one example of a sheet support portion of the present invention) and a sheet discharge tray 21 can be inserted into and pulled out of an inner space of the MFP 10 via the opening 13 in the front-rear direction 8. On the sheet supply tray 20, recording sheets of desired sizes are placed or supported. As shown in FIG. 2, the printer unit 11 includes a sheet supplying portion 15 configured to supply the recording sheet, feed roller pairs 58 and discharge roller pairs 59 configured to feed or convey the recording sheet, and a recording portion 24 of an ink-jet recording type configured to record an image on the recording sheet. The printer unit 11 is configured to record, on the recording sheet, an image on the basis of print data or the like transmitted from an external device.

<Sheet Supplying Portion 15>

As shown in FIG. 2, the sheet supplying portion 15 is provided on an upper side of the sheet supply tray 20. The sheet supplying portion 15 includes a sheet supply roller 25, a sheet supply arm 26, and a rotation transmitting mechanism 27 (as one example of a rotation transmitting portion of the present invention) constituted by a plurality of gears meshing with one another. The sheet supply roller 25 is held at a distal end of the sheet supply arm 26 such that the sheet supply roller 25 is rotatable about a rotation axis thereof. The sheet supply arm 26 is pivotable, in directions indicated by arrows 29, about a shaft 28 provided at a proximal end thereof. The shaft 28 is for rotating the sheet supply roller 25 and is one example of a third shaft in the present invention. (The shaft 28 will be hereinafter referred to as the "sheet supply shaft 28" for the sake of convenience.) According to the arrangement, the sheet supply roller 25 can be brought into contact with and separated from the sheet supply tray 20. The sheet supply roller 25 is configured to be rotated by a rotation of the sheet supply shaft 28 transmitted thereto via the rotation transmitting mechanism 27. In a state in which the sheet supply roller 25 is in contact with an uppermost one of the recording sheets stacked in the sheet supply tray 20, the sheet supply roller 25 separates the uppermost sheet from the other sheets so as to supply the uppermost sheet to a curved path section 65A of a sheet feeding path 65 (that will be explained).

<Sheet Feeing Path 65>

As shown in FIG. 2, there is formed, in an inside of the printer unit 11, the sheet feeing path 65 extending from an end (i.e., a rear end) of the sheet supply tray 20 to the sheet discharge tray 21 via the recording portion 24, for guiding the recording sheet. The sheet feeing path 65 is constituted by the curved path section 65A extending from the rear end of the sheet supply tray 20 to the feed roller pairs 58 and a straight path section 65B extending from the feed roller pairs 58, passing right below the recording portion 24, and finally reaching the sheet discharge tray 21.

The curved path section 65A is a curved path extending from a vicinity of the rear end of the sheet supply tray 20 to the feed roller pairs 58. The recording sheet is guided, while being curved, through the curved path section 65A in a sheet feeding direction (indicated by arrows attached to the long dashed short dashed line in FIG. 2). The curved path section 65A is connected or continuous to the straight path section 65B with the feed roller pairs 58 interposed therebetween. In the arrangement, the recording sheet is guided to the straight path section 65B via the curved path section 65A. The curved path section 65A is defined by an inner guide member 19 and an outer guide member 17 that are opposed to each other with a prescribed spacing therebetween.

The straight path section 65B is a straight path extending in the front-rear direction 8 from a downstream end, in the sheet feeding direction, of the curved path section 65A, i.e., from the feed roller pairs 58, to the sheet discharge tray 21. The recording sheet is guided through the straight path section 65B in the sheet feeding direction (indicated by arrows attached to the long dashed double-short dashed line in FIG. 2). The recording sheet is discharged to the sheet discharge tray 21 after an image has been recorded thereon by the recording portion 24. The straight path section 65B is defined, at a region thereof corresponding to the recording portion 24, by the recording portion 24 and a platen 42 that are opposed to each other with a prescribed spacing therebetween and is defined, at a region thereon not corresponding to the recording portion 24, by an upper guide member 52 and a lower guide member 53 that are opposed to each other with a prescribed spacing therebetween.

<Recording Portion 24>

As shown in FIG. 2, the recording portion 24 is provided above the straight path section 65B. The recording portion 24 includes: a recording head 38 configured to eject ink as minute ink droplets from nozzles formed in a nozzle surface 39; and a carriage 40 on which the recording head 38 is mounted and which is configured to reciprocate in a main scanning direction (the left-right direction 9).

The carriage 40 is supported by guide rails (not shown) attached to a frame (not shown) provided in the inside of the printer unit 11. To be more specific, the guide rails are disposed so as to be spaced apart from each other in the sheet feeding direction with a prescribed distance therebetween. The guide rails extend in the left-right direction 9. The carriage 40 bridges the guide rails so as to be slidable on the guide rails in the left-right direction 9.

To the recording head 38 mounted on the carriage 40, ink is supplied from an ink cartridge not shown. The nozzles are formed in the lower surface of the recording head 38 functioning as the nozzle surface 39. The ink droplets are ejected from the nozzles toward the platen 42 that is disposed at a position where the platen 42 is opposed to the recording portion 24 with the straight path section 65B interposed therebetween. The recording sheet that is being fed in the sheet feeding direction is supported by the platen 42.

In the arrangement above, during the reciprocating movement of the carriage 40 in the main scanning direction, the ink droplets are ejected from the nozzles toward the recording sheet that is being fed on the platen 42, whereby an image is recorded on the recording sheet.

<Feed Roller Pairs 58 and Discharge Roller Pairs 59>

Figure 3:
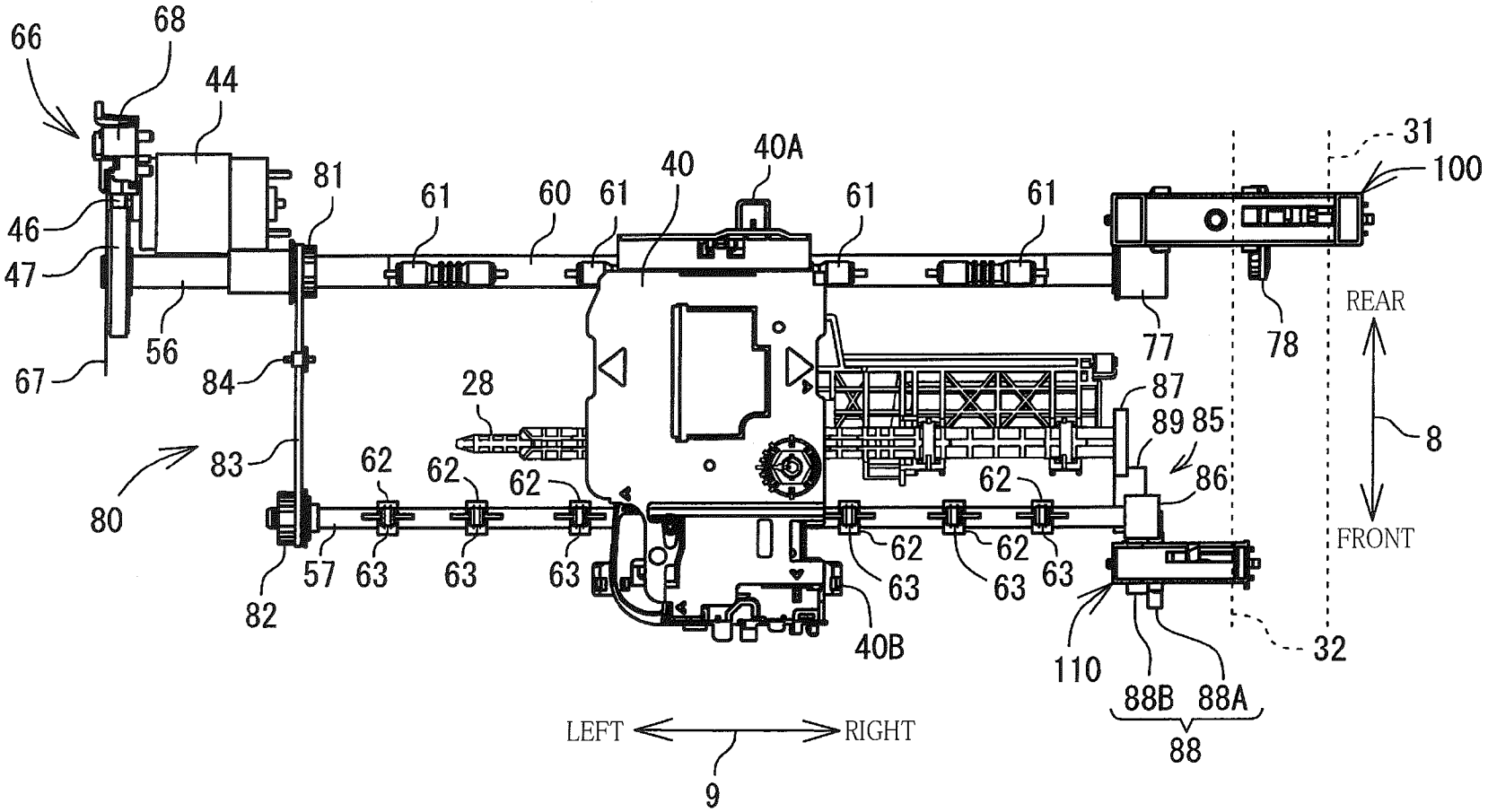
FIG. 3 is a plan view showing an internal structure of the printer unit 11.

As shown in FIG. 2, on an upstream side, in the sheet feeding direction, of the recording portion 24 in the straight path section 65B, there are provided the feed roller pairs 58 constituted by a feed roller 60 disposed on a lower side of the straight path section 65B and a plurality of pinch rollers 61 disposed on an upper side of the straight path section 65B so as to be opposed to the feed roller 60. As shown in FIG. 3, the feed roller 60 is formed by coating a surface of a shaft 56 with a ceramic material, for instance, and continuously extends in the left-right direction 9 in a region over which the recording sheet can pass. The shaft 56 is for rotating the feed roller 60 and is one example of a first shaft in the present invention. (The shaft 56 will be hereinafter referred to as the "sheet feed shaft 56" for the sake of convenience.) The pinch rollers 61 are disposed so as to be spaced apart from one another in the left-right direction 9, such that the pinch rollers 61 are held in contact with a plurality of portions of the feed roller 60. The pinch rollers 61 are held in pressing contact with a roller surface of the feed roller 60 by respective elastic members (not shown) such as springs. The feed roller pairs 58 are configured to hold or nip the recording sheet between the feed roller 60 and the pinch rollers 61 and to feed the recording sheet toward a downstream side in the sheet feeding direction, namely, toward the platen 42.

As shown in FIG. 3, an optical rotary encoder 66 is provided at a left end portion of the sheet feed shaft 56. The rotary encoder 66 includes: a disc 67 fitted on the sheet feed shaft 56 and configured to rotate together with the sheet feed shaft 56; and an optical sensor 68 disposed so as to be opposed to the disc 67 and configured to read a rotation of the disc 67. The rotary encoder 66 is of the so-called incremental type. Slits are formed along a circumferential direction of the disc 67 in an equally (equiangularly) spaced apart relation. In association with a rotation of the sheet feed shaft 56, each slit passes the optical sensor 68. Every time when each slit passes, the signal level of the optical sensor 68 changes in two steps. The rotary encoder 66 outputs, as a pulse signal, an output of the optical sensor 68, to a controller 130 (FIG. 5) that will be later described. The controller 130 counts the pulse signal obtained from the rotary encoder 66, thereby obtaining an amount of the rotation of the sheet feed shaft 56 (the feed roller 60).

As shown in FIG. 2, on the downstream side, in the sheet feeding direction, of the recording portion 24 in the straight path section 65B, there are disposed the discharge roller pairs 59 each constituted by a discharge roller 62 disposed on the lower side of the straight path section 65B and a spur 63 disposed on the upper side of the straight path section 65B so as to be opposed to the corresponding discharge roller 62. As shown in FIG. 3, the discharges rollers 62 are fitted on a shaft 57 at a plurality of positions thereof in the left-right direction 9. The shaft 57 is for rotating the discharge rollers 62 and is one example of a second shaft of the present invention. (The shaft 57 will be hereinafter referred to as the "sheet discharge shaft 57" for the sake of convenience.) The spurs 63 are provided so as to correspond to the respective discharge rollers 62. Each of the spurs 63 is held in pressing contact with a roller surface of the corresponding discharge roller 62 by an elastic member (not shown) such as a spring. The discharge roller pairs 59 are configured to hold or nip the recording sheet that has passed the recording portion 24 and to convey the recording sheet toward the downstream side in the sheet feeding direction, namely, toward the sheet discharge tray 21.

One example of a sheet feeder of the present invention is constituted by the sheet supply roller 25, the feed roller 60, the discharge rollers 62, a feed motor 44, and a mechanism for transmitting a drive force of the feed motor 44 to the sheet supply roller 25, the feed roller 60, and the discharge rollers 62. The mechanism for transmitting the drive force of the feed motor 44 will be later explained in detail.

<Purging Mechanism 70>

The MFP 10 is equipped with a purging mechanism 70 (as one example of a maintenance portion of the present invention) shown in FIG. 4. The purging mechanism 70 is configured to perform a purging operation to perform maintenance of the nozzles formed in the nozzle surface 39 of the recording head 38, more specifically, to remove by suction air bubbles and foreign substances together with the ink. The purging mechanism 70 includes: a cap 71 configured to cover the nozzle surface 39 of the recording head 38; a pump 72 (FIG. 5) configured to be brought into communication with the cap 71 for performing suction; a lift-up mechanism 73 configured to bring the cap 71 into contact with the nozzle surface 39 and to separate the cap 71 from the nozzle surface 39; and a waste-liquid tank (not shown) into which the ink and the like sucked by the pump 72 is to flow.

The purging mechanism 70 is disposed on a right side of a region over which the carriage 40 reciprocates during an image recording operation. (This region will be hereinafter referred to as an "image recording region" where appropriate.) It is noted that the image recording region corresponds to the above-indicated region over which the recording sheet can pass. More specifically, the purging mechanism 70 is disposed at a position where the purging mechanism 70 is to be opposed to the carriage 40 when the carriage 40 is moved to a first position 31 (FIG. 3) that is located on the right side of the image recording region. When the carriage 40 is moved to the first position 31 located on the right side of the image recording region, the cap 71 is brought into close contact with the nozzle surface 39 by the lift-up mechanism 73, so that the nozzles are covered by the cap 71 and a hermetically sealed space is formed between the cap 71 and the nozzle surface 39. A tube (not shown) or the like extends from a bottom of the cap 71 for bringing the hermetically sealed space into communication with the pump 72.

The pump 72 is a tube pump of a rotary type, for instance. When the pump 72 is driven, the hermetically sealed space formed between the cap 71 and the nozzle surface 39 is brought into a negative-pressure state. Owing to the reduction in the internal pressure, the air bubbles and the foreign substances are removed by suction together with the ink, from the nozzles formed in the nozzle surface 39 of the recording head 38. The ink and the foreign substances removed by suction are sent to the waste-liquid tank via the pump 72. The pump 72 is operated by the drive force of the feed motor 44 transmitted thereto. The feed motor 44 is one example of a drive motor of the present invention. The details will be later explained.

Figure 4A:
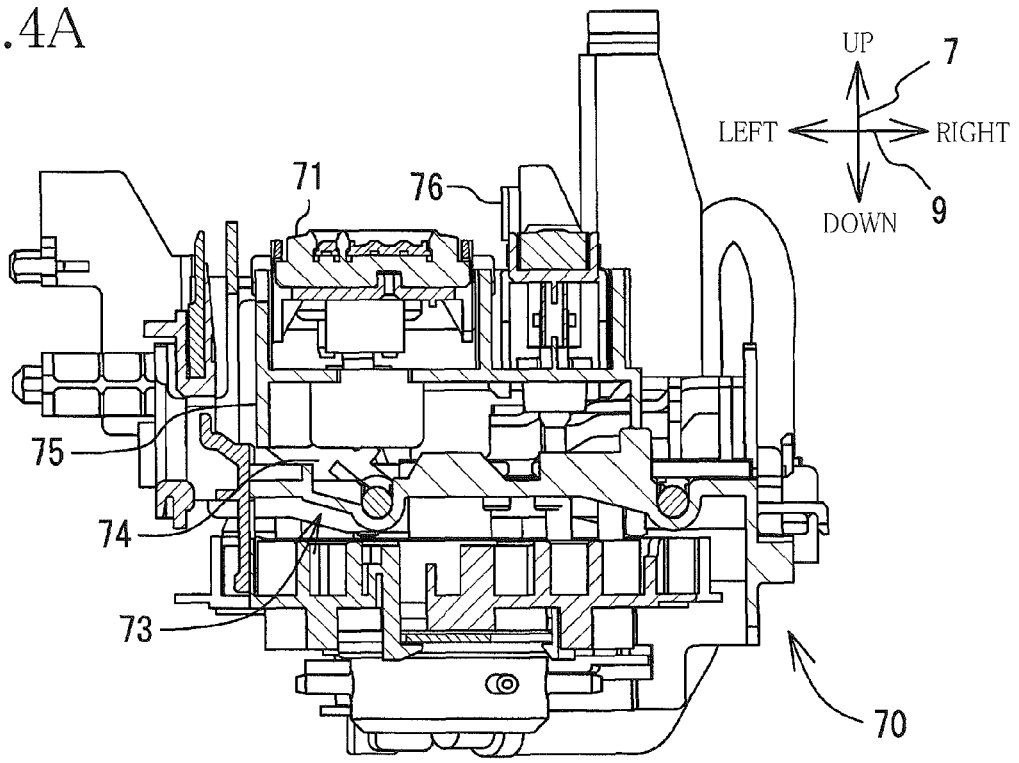
FIGS. 4A and 4B are cross-sectional views of a purging mechanism 70, more specifically.
Figure 4B:
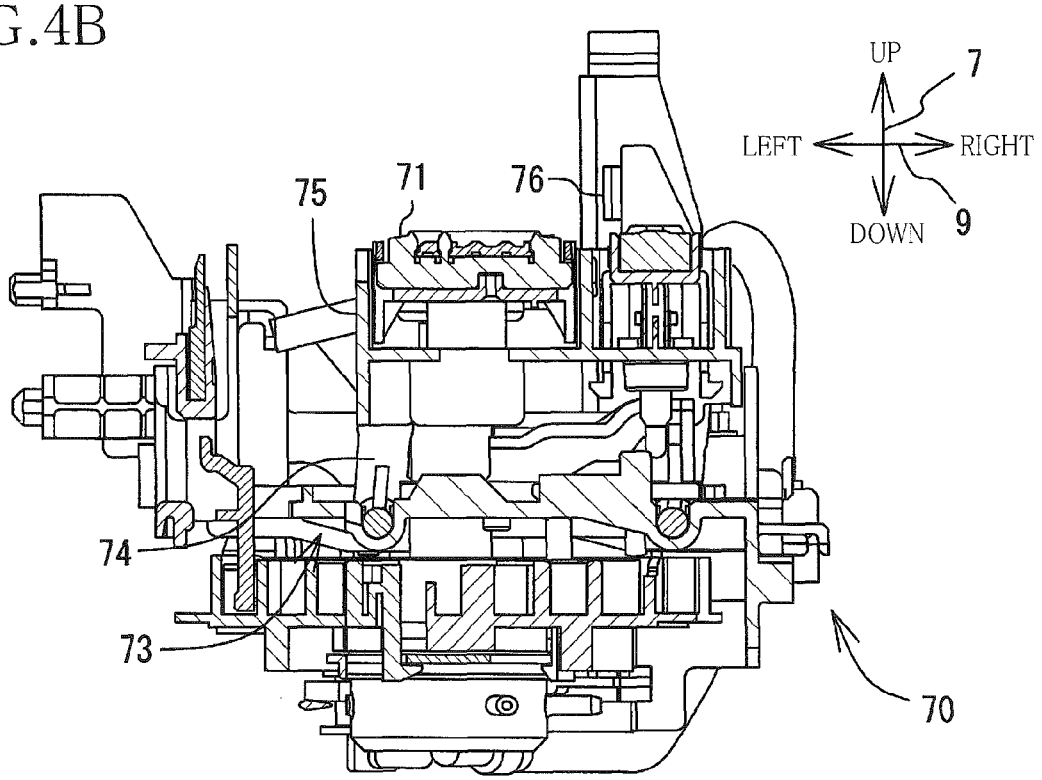

As shown in FIGS. 4A and 4B, the lift-up mechanism 73 includes a pair of link members 74, i.e., left and right link members 74, having mutually the same length. The link members 74 pivot, so that a holder 75 moves between a position shown in FIG. 4A and a position shown in FIG. 4B. The holder 75 includes a contact lever 76 that protrudes vertically upward. The carriage 40 pushes the contact lever 76 rightward when the carriage 40 moves to the first position 31, whereby the holder 75 is moved to the position shown in FIG. 4B. When the holder 75 is moved to the position shown in FIG. 4B, the cap 71 is brought into close contact with the nozzle surface 39 of the recording head 38. When the carriage 40 moves leftward from the first position 31, the holder 75 is moved to the position shown in FIG. 4A, so that the cap 71 is separated away from the recording head 38.

<Controller 130>

Figure 5:
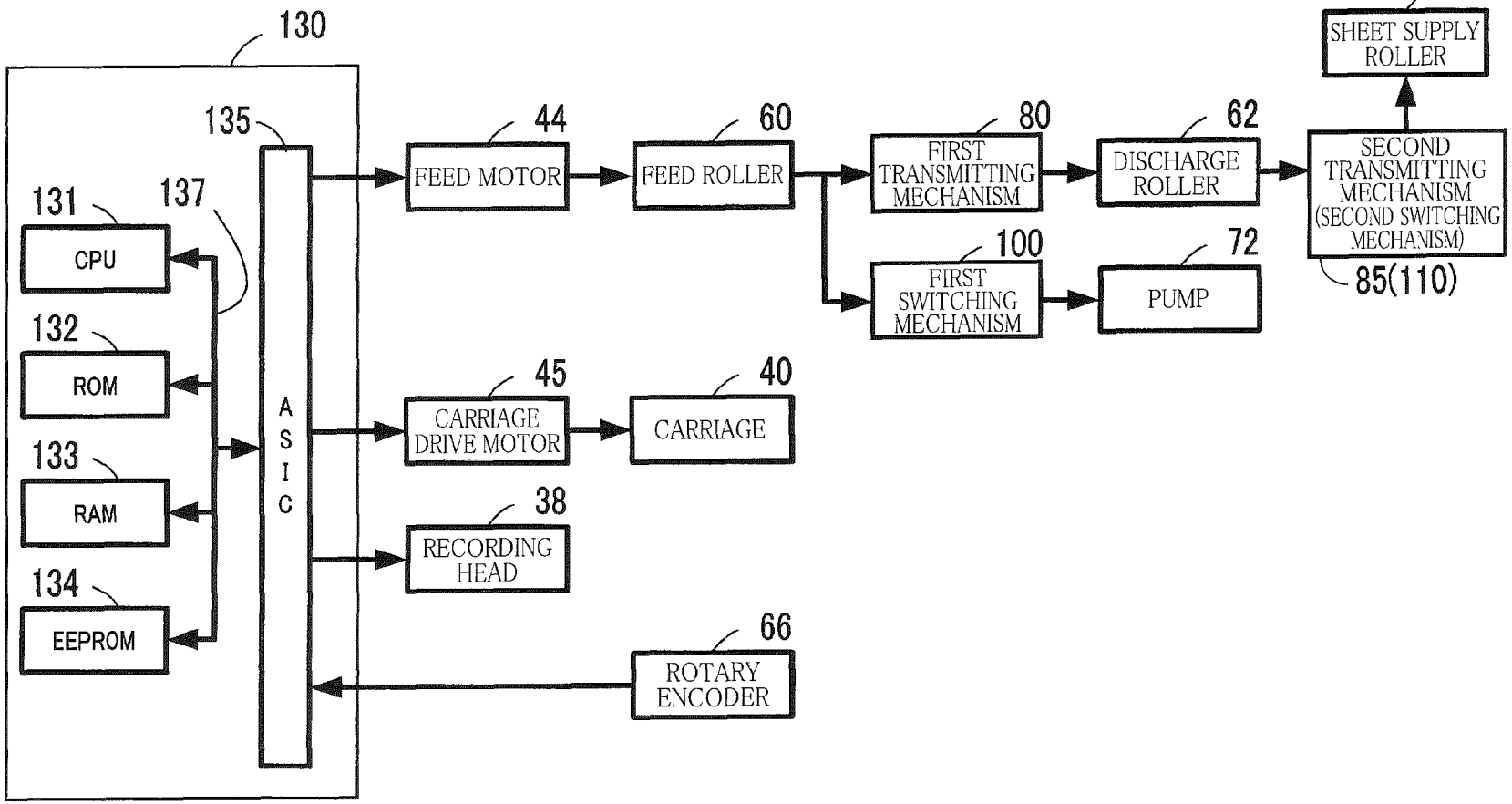
FIG. 5 is a block diagram of the printer unit 11.

The controller 130 shown in FIG. 5 is for controlling overall operations of the MFP 10. The controller 130 is constituted by a microcomputer mainly including a CPU 131, a ROM 132, a RAM 133, an EEPROM 134, and an ASIC 135 that are connected to one another by an internal bus 137.

The ROM 132 stores programs and so on by which the CPU 31 controls various operations of the MFP 10 including the image recording operation. The RAM 133 is utilized as a storage area in which data, signals, and so on to be used when the programs are executed by the CPU 13 are temporarily recorded or as a work area for data processing. The EEPROM 134 stores settings, flags, and so on which should be kept after the MFP10 is turned off.

The feed motor 44, a carriage drive motor 45, the recording head 38, and the rotary encoder 66 are electrically connected to the ASIC 135. In the ASIC 135, drive circuits for controlling the motors and the recording head 38 are incorporated. Into the ASIC 135, the pulse signal indicative of the rotation amount of the feed roller 60 is inputted from the rotary encoder 66. The controller 130 is configured to calculate the rotation amount of the feed roller 60 on the basis of the pulse signal and to control the feed motor 44 to rotate such that the calculated rotation amount coincides with a target rotation amount.

<Transmitting Mechanism for Transmitting Drive Force of Feed Motor 44>

Referring to FIGS. 2, 3, and 5-10, there will be explained a mechanism for transmitting the drive force of the feed motor 44 to various components. As shown in FIG. 3, the sheet feed shaft 56, the sheet discharge shaft 57, and the sheet supply shaft 28 extend in the left-right direction 9 (as a width direction) that is orthogonal to the sheet feeding direction. Further, as shown in FIG. 2, the sheet supply shaft 28 is disposed at a position where a linear distance between the sheet supply shaft 28 and the sheet discharge shaft 57 is shorter than a linear distance between the sheet supply shaft 28 and the sheet feed shaft 56. At the left end portion of the sheet feed shaft 56, a motor gear 46 provided on the feed motor 44 and a roller gear 47 fitted on the left end portion of the sheet feed shaft 56 are in mesh with each other, whereby the drive force of the feed motor 44 is transmitted to the sheet feed shaft 56.

The rotation of the sheet feed shaft 56 is transmitted to the sheet discharge shaft 57 by a first transmitting mechanism 80. As shown in FIG. 3, the first transmitting mechanism 80 is disposed on the left side of the sheet feeing path 65 in the left-right direction 9, so as to connect the left end portion of the sheet feed shaft 56 and a left end portion of the sheet discharge shaft 57 to each other. That is, the first transmitting mechanism 80 is disposed on the same side in the left-right direction 9 as the motor gear 46 and the roller gear 47. That is, the first transmitting mechanism 80 is disposed on the same side as the mechanism for transmitting the drive force from the feed motor 44 to the sheet feed shaft 56.

Figure 6:
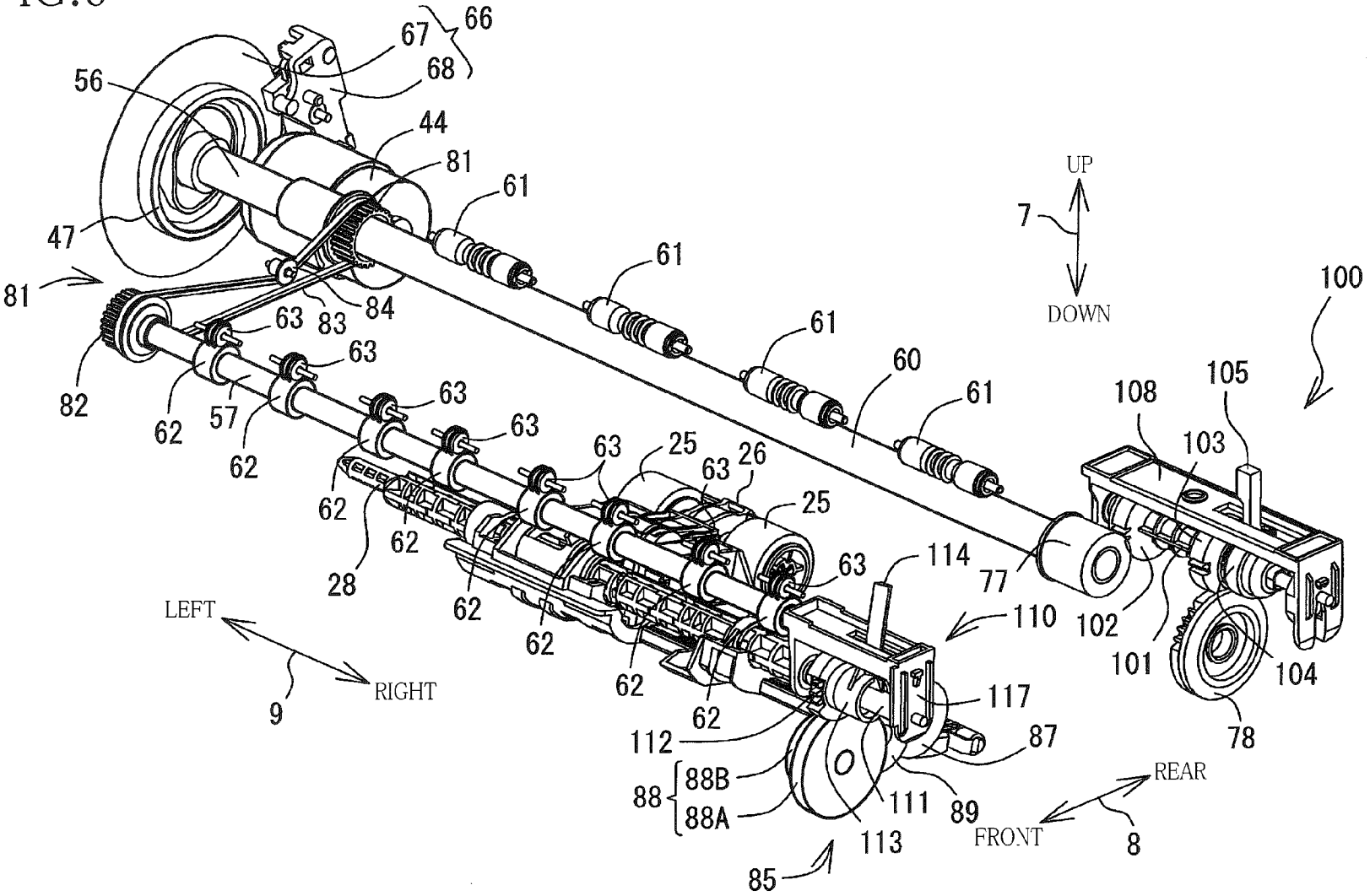
FIG. 6 is a perspective view of an inside of the printer unit 11 as viewed from an upper front side.
Figure 7:
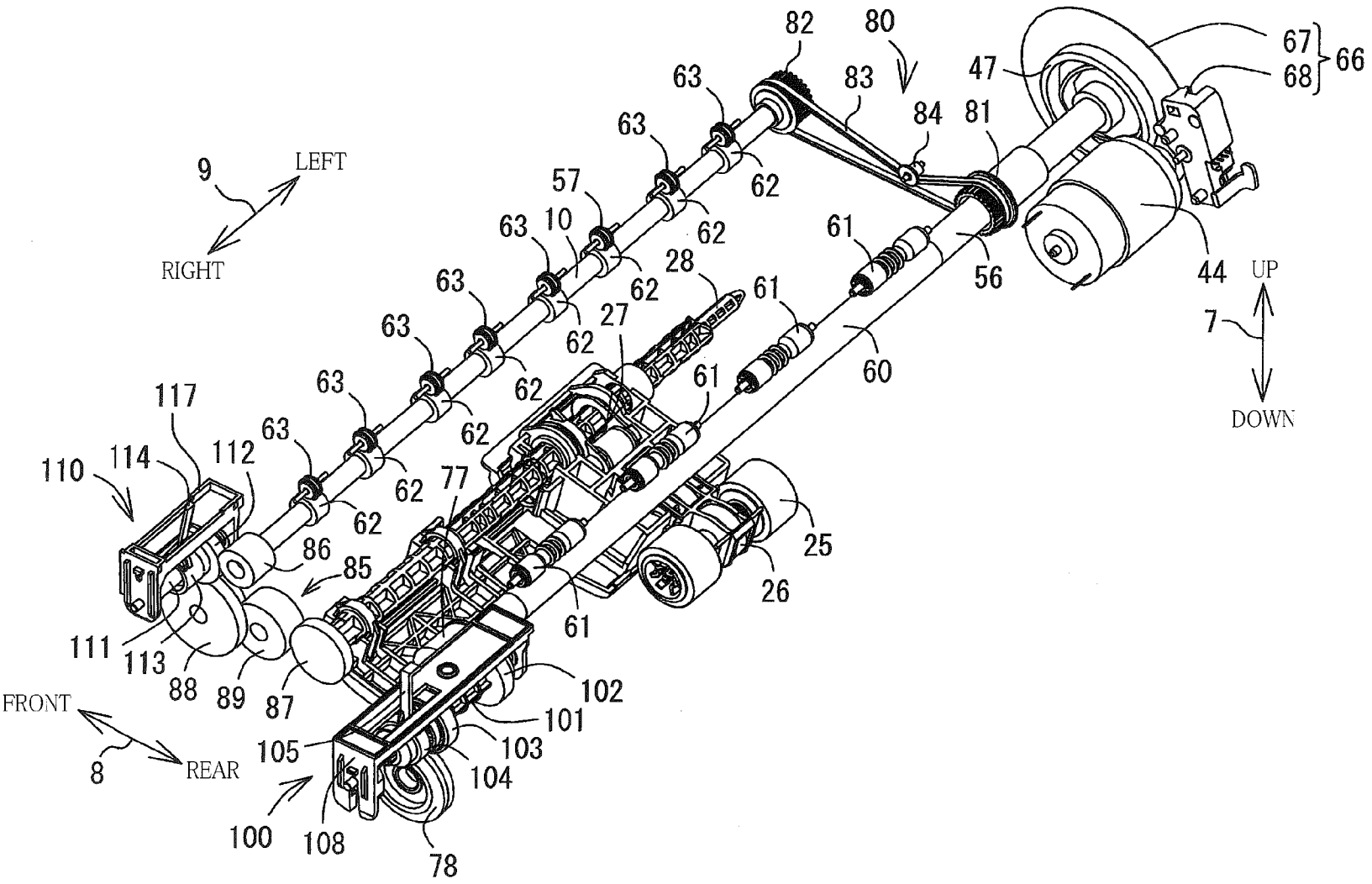
FIG. 7 is a perspective view of the inside of the printer unit 11 as viewed from an upper right side.
Figure 8:
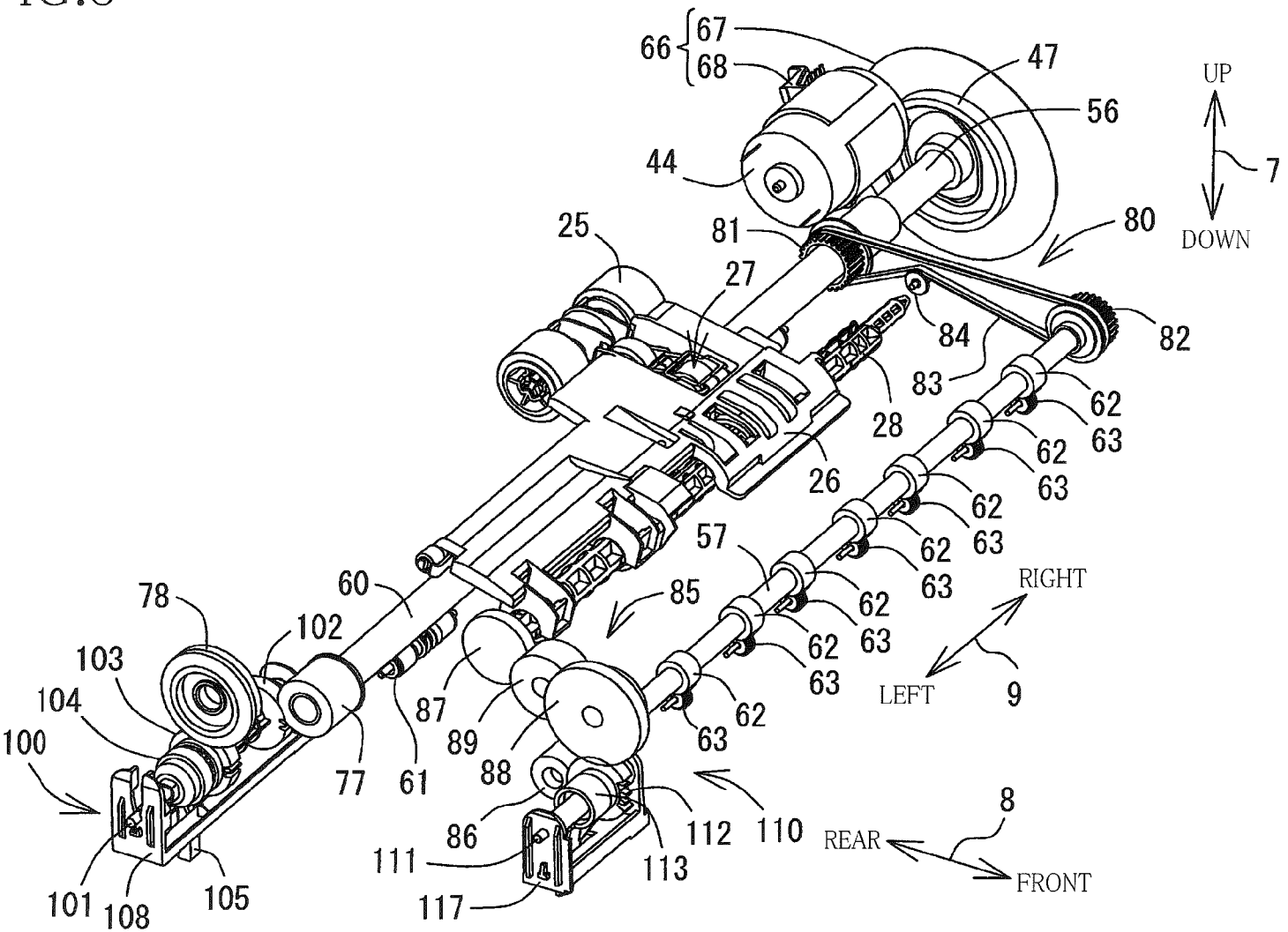
FIG. 8 is a perspective view of the inside of the printer unit 11 as viewed from a lower left side.

As shown in FIGS. 6-8, the first transmitting mechanism 80 includes a plurality of pulleys and a belt looped over the pulleys. The first transmitting mechanism 80 in the present embodiment is constituted by: a first pulley 81 fitted on the sheet feed shaft 56; a second pulley 82 fitted on the sheet discharge shaft 57; a belt 83 looped over the first pulley 81 and the second pulley 82 and configured to transmit a rotation of the first pulley 81 to the second pulley 82; and a tensioner 84 configured to give a tension to the belt 83. The first pulley 81 is disposed at the left end portion of the sheet feed shaft 56 such that the first pulley 81 is located on the right side of the roller gear 47 and on the left side of the feed roller 60. The second pulley 82 is disposed at the left end portion of the sheet discharge shaft 57.

A rotation of the sheet discharge shaft 57 is transmitted to the sheet supply shaft 28 by a second transmitting mechanism 85. As shown in FIG. 3, the second transmitting mechanism 85 is disposed on the right side of the sheet feeing path 65 in the left-right direction 9, so as to connect a right end portion of the sheet discharge shaft 57 and a right end portion of the sheet supply shaft 28 to each other. That is, the first transmitting mechanism 80 and the second transmitting mechanism 85 are disposed on one and the other sides of the sheet feeing path 65 in the left-right direction 9.

As shown in FIGS. 6-8, the second transmitting mechanism 85 includes a plurality of gears. The second transmitting mechanism 85 in the present embodiment is constituted by: a first gear 86 fitted on the sheet discharge shaft 57; a second gear 87 fitted on the sheet supply shaft 28; idle gears 88, 89 for transmitting a rotation of the first gear 86 to the second gear 87; and a second switching mechanism 110. The first gear 86 is disposed at the right end portion of the sheet discharge shaft 57 and is always in mesh with a movable gear 112 (that will be later explained) of the second switching mechanism 110. The second gear 87 is disposed at the right end portion of the sheet supply shaft 28 and is always in mesh with the idle gear 89. The idle gear 88 is constituted by a large-diameter portion 88A and a small-diameter portion 88 that are adjacent to each other in a thrust direction so as to rotate integrally with each other. The large-diameter portion 88A can mesh with the movable gear 112, and the small-diameter portion 88B is always in mesh with the idle gear 89. The second switching mechanism 110 is for switching whether or not to transmit the rotation of the sheet discharge shaft 57 to the sheet supply shaft 28. The details of the second switching mechanism 110 will be later explained in detail.

Where the feed motor 44 is rotated one of forwardly or reversely when the second switching mechanism 110 is in a third state (that will be later described), the sheet supply roller 25 rotates in a direction in which the recording sheet is supplied while the feed roller 60 and the discharge rollers 62 rotate in a direction opposite to a direction in which the recording sheet is fed or conveyed in the sheet feeding direction. That is, the rotational direction of the feed roller 60 and the rotational direction of the discharge rollers 62 are mutually the same while the rotational direction of the sheet supply roller 25 and the rotational directions of the feed roller 60 and the discharge rollers 62 are opposite. The structure for making the rotational direction of the sheet supply roller 25 opposite to the rotational directions of the feed roller 60 and the discharge rollers 62 is not particularly limited. For instance, such a structure may be realized by providing even-numbered gears between the first gear 86 and the second gear 87 in the second transmitting mechanism 85, namely, by making the number of the idle gears even. Alternatively, such a structure may be realized by adjusting the number of the gears that constitute the rotation transmitting mechanism 27. On the other hand, where the feed motor 44 is rotated the one of forwardly or reversely when the second switching mechanism 110 is in a fourth state (that will be later described), the rotation of the feed motor 44 is not transmitted to the sheet supply roller 25.

On the other hand, where the feed motor 44 is rotated the other of forwardly and reversely, the feed roller 60 and the discharge roller 62 rotate in the direction in which the recording sheet is fed or conveyed in the sheet feeding direction, and the drive force is not transmitted to the sheet supply roller 25. The structure for transmitting only one of the forward rotation and the reverse rotation of the feed motor 44 to the sheet supply roller 25, in other words, the structure for not transmitting the other of the forward rotation and the reverse rotation, is not particularly limited. For instance, such a structure may be realized by providing, in the second transmitting mechanism 85, a one-way clutch or a transmission mechanism using planetary gears. The one-way clutch or the transmission mechanism using the planetary gears may be provided in the rotation transmitting mechanism 27.

As shown in FIGS. 6-10, the drive force of the feed motor 44 is transmitted to the pump 72 of the purging mechanism 70 via the sheet feed shaft 56, a drive gear 77, a first switching mechanism 100, a driven gear 78, and a shaft 79. The drive gear 77 is fitted on a right end portion of the sheet feed shaft 56. The driven gear 78 is fitted on the shaft 79 by which the pump 72 is rotated. The first switching mechanism 100 is disposed between the drive gear 77 and the driven gear 78. The first switching mechanism 100 is for switching whether or not to transmit a rotation of the drive gear 77 to the driven gear 78.

As shown in FIG. 9, the first switching mechanism 100 is constituted by: a shaft 101; a fixed gear 102 and a movable gear 103 fitted on the shaft 101; a contact member 104 that is in contact with a right-side face of the movable gear 103; a lever 105 that extends upward from the contact member 104: coil springs 106, 107 configured to elastically press the movable gear 103; and a frame 108.

The shaft 101 extends in the left-right direction 9 so as to be rotatably supported by the frame 108. The fixed gear 102 is provided at a left end of the shaft 101 and is always in mesh with the drive gear 77. The movable gear 103 is supported, at a position on the right side of the fixed gear 102, by the shaft 101 so as to be slidable in the left-right direction 9. The fixed gear 102 and the movable gear 103 rotate integrally with the shaft 101. The contact member 104 is supported, at a position adjacent to the movable gear 103 in the left-right direction 9, by the shaft 101 so as to be slidable in the left-right direction 9. The lever 105 extends upward from the contact member 104, and a distal end thereof is located on a movement path of the carriage 40. That is, in the course of a rightward movement of the carriage 40 to the first position 31 (FIG. 3) that is located on the right side of the image recording region, the lever 105 comes into contact with a first contact portion 40A (FIG. 3) of the carriage 40 and subsequently moves rightward.

The coil spring 106 is fitted on the shaft 101 on the left side of the movable gear 103. The coil spring 106 is fixed, at its left end, to a fixation portion of a frame or the like (not shown) of the MFP 10 and is held, at its right end, in contact with a left-side face of the movable gear 103. That is, the coil spring 106 is configured to elastically bias the movable gear 103 in the rightward direction. The coil spring 107 is fitted on the shaft 101 on the right side of the movable gear 103. The coil spring 107 is fixed, at its right end, to a fixation portion of the frame or the like (not shown) of the MFP 10 and is held, at its left end, in contact with a right-side face of the contact member 104. That is, the coil spring 107 is configured to elastically bias the movable gear 103 in the leftward direction via the contact member 104.

Figure 9A:
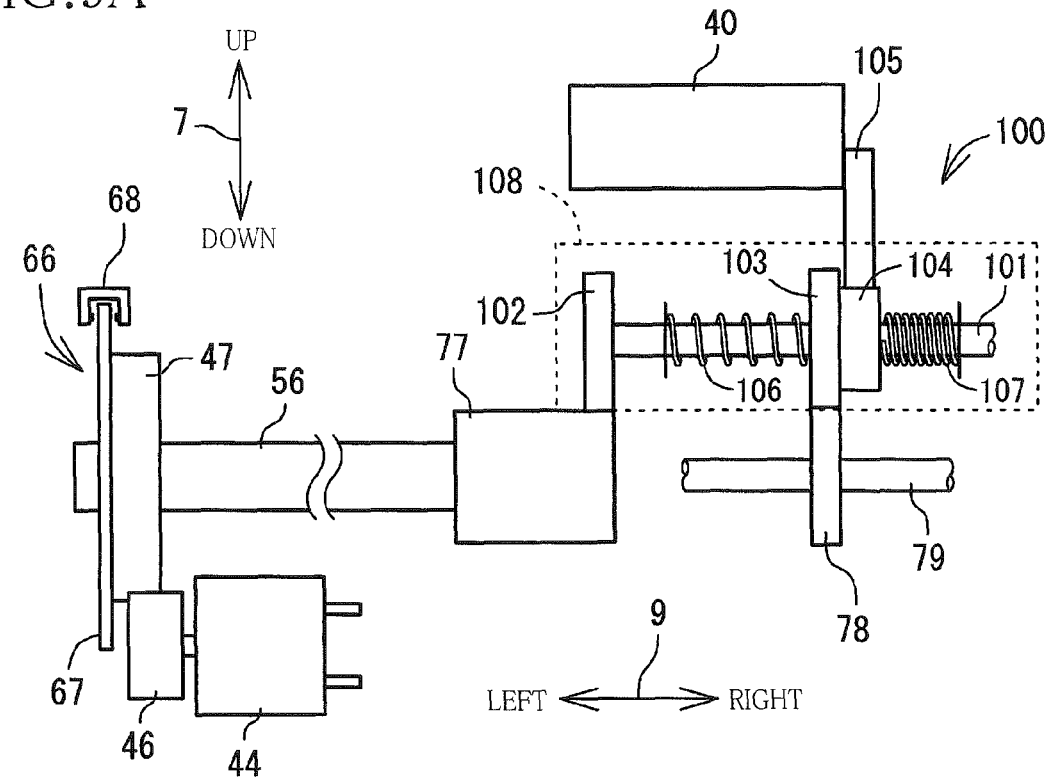
FIGS. 9A and 9B are views schematically showing a structure of a first switching mechanism 100, more specifically.

When the carriage 40 moves the lever 105 to a position shown in FIG. 9A, namely, when the carriage 40 reaches the first position 31, the contact member 104 is moved rightward together with the lever 105 against the biasing force of the coil spring 107, so that the biasing force of the coil spring 107 no more acts on the movable gear 103. As a result, the movable gear 103 receives the biasing force of the coil spring 106 so as to move rightward, and consequently comes into meshing with the driven gear 78. In this instance, the drive force of the feed motor 44 is transmitted to the pump 72 via the drive gear 77, the fixed gear 102, the movable gear 103, the driven gear 78, and the shaft 79, whereby the pump 72 is driven. Hereinafter, the state of the first switching mechanism 100 shown in FIG. 9A, namely, the state in which the movable gear 103 and the driven gear 78 are in mesh with each other, is referred to as a first state.

Figure 9B:
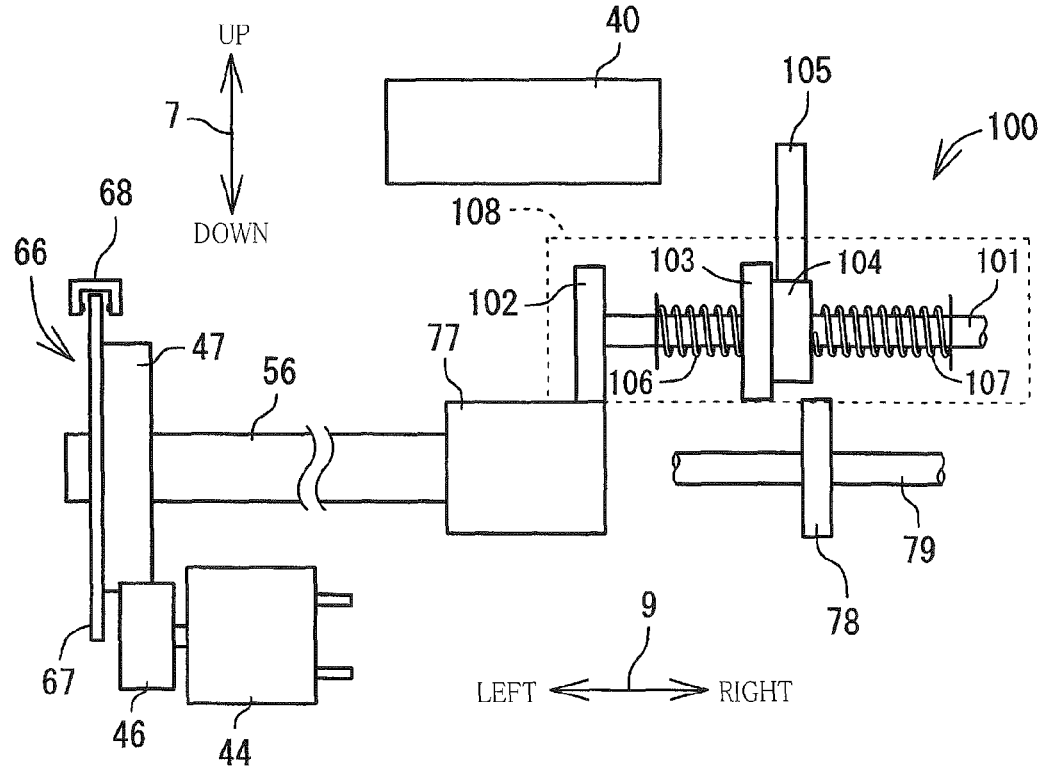

In the meantime, the biasing force of the coil spring 107 is set to be larger than that of the coil spring 106. Accordingly, when the carriage 40 moves leftward from the first position 31 and separates away from the lever 105, as shown in FIG. 9B, the movable gear 103 that receives the biasing force of the coil spring 107 moves leftward against the biasing force of the coil spring 106, so that the movable gear 103 disengages from the driven gear 78, in other words, meshing of the movable gear 103 and the driven gear 78 is released. In this instance, the drive force of the feed motor 44 is not transmitted to the pump 72. Hereinafter, the state of the first switching mechanism 100 shown in FIG. 9B, namely, the state in which meshing of the movable gear 103 and the driven gear 78 is released, is referred to as a second state.

That is, the first switching mechanism 100 is configured to be placed selectively in one of the first state in which the rotation of the sheet feed shaft 56 is transmitted to the pump 72 and the second state in which the rotation of the sheet feed shaft 56 is not transmitted to the pump 72. The first switching mechanism 100 is configured such that the state thereof is changed from the second state to the first state when the carriage 40 reaches the first position 31 and such that the state is changed from the first state to the second state when the carriage 40 moves from the first position 31 in the leftward direction. In other words, the first switching mechanism 100 is configured to be placed in the second state when the carriage 40 is located in the image recording region (such as when an image is being recorded on the recording sheet) and is configured to be placed in the first state only when the carriage 40 reaches the first position 31.

As shown in FIG. 10, the second switching mechanism 110 is constituted by: a shaft 111; the movable gear 112 fitted on the shaft 111; a contact member 113 that is in contact with a right-side face of the movable gear 112; a lever 114 that extends upward from the contact member 113; coil springs 115, 116 configured to elastically press the movable gear 112; and a frame.

The shaft 111 extends in the left-right direction 9 and is rotatably supported by the frame 117. The movable gear 112 is supported by the shaft 111 so as to be slidable in the left-right direction 9. The movable gear 112 is configured to rotate integrally with the shaft 111. The contact member 113 is supported, at a position adjacent to the movable gear 112 in the left-right direction 9, by the shaft 111 so as to be slidable in the left-right direction 9. The lever 114 extends upward from the contact member 113, and a distal end thereof is located on the movement path of the carriage 40. That is, in the course of the rightward movement of the carriage 40 to a second position 32 (FIG. 3) that is located on the right side of the image recording region and on the left side of the first position 31, the lever 114 comes into contact with a second contact portion 40B of the carriage 40 and subsequently moves rightward.

The coil spring 115 is fitted on the shaft 111 on the left side of the movable gear 112. The coil spring 115 is fixed, at its left end, to a fixation portion of the frame or the like (not shown) of the MFP 10 and is held, at its right end, in contact with a left-side face of the movable gear 112. That is, the coil spring 115 is configured to elastically bias the movable gear 112 in the rightward direction. The coil spring 116 is fitted on the shaft 11 on the right side of the movable gear 112. The coil spring 116 is fixed, at its right end, to a fixation portion of the frame or the like (not shown) of the MFP 10 and is held, at its left end, in contact with a right-side face of the contact member 113. That is, the coil spring 116 is configured to elastically bias the movable gear 112 in the leftward direction via the contact member 113.

Figure 10A:
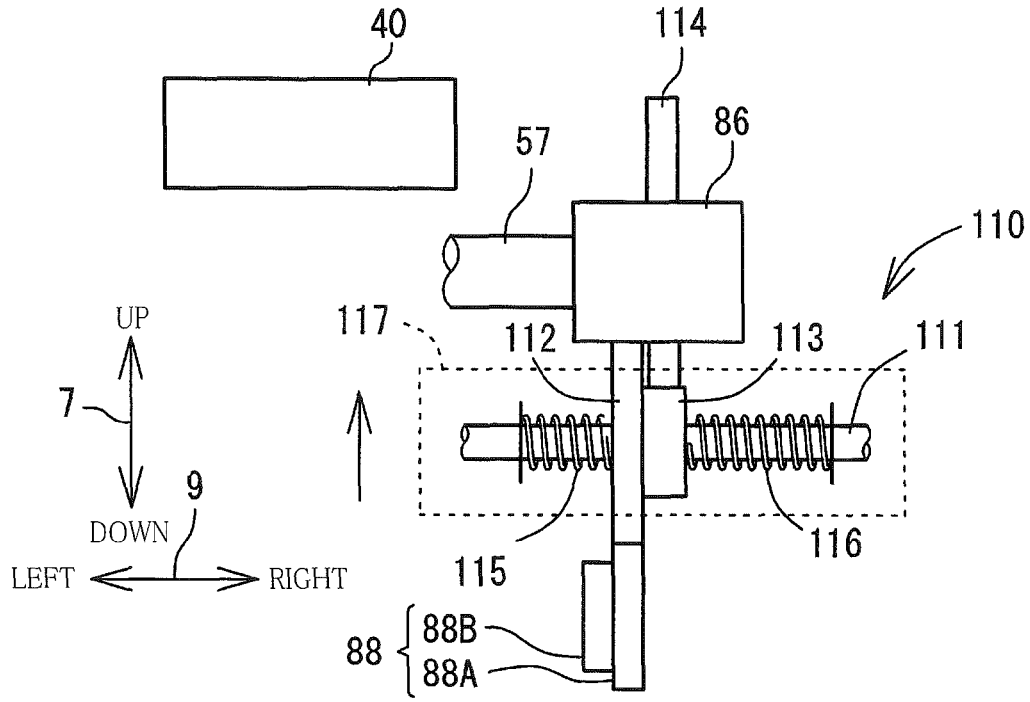
FIGS. 10A and 10B are views schematically showing a structure of a second switching mechanism 110, more specifically.

Here, the biasing force of the coil spring 116 is set to be larger than that of the coil spring 115. Accordingly, as shown in FIG. 10A, in a state in which the carriage 40 is located away from the lever 114, the movable gear 112 is kept at a position at which the movable gear 112 is in mesh with the large-diameter portion 88A of the idle gear 88. In this instance, the drive force of the feed motor 44 is transmitted to the sheet supply shaft 28 via the first gear 86, the movable gear 112, the idle gears 88, 89, and the second gear 87. Hereinafter, the state of the second switching mechanism 110 shown in FIG. 10A, namely, the state in which the movable gear 112 and the large-diameter portion 88A of the idle gear 88 are in mesh with each other, is referred to as the third state.

Figure 10B:
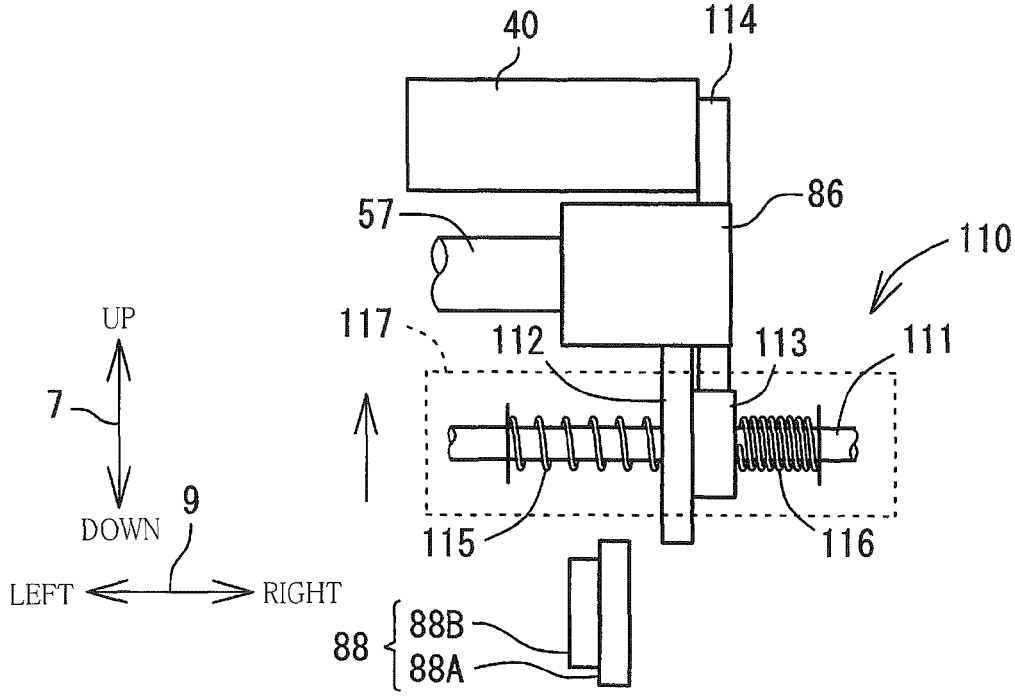

In the meantime, when the carriage 40 moves the lever 114 to a position shown in FIG. 10B, namely, when the carriage 40 reaches the second position 32, the contact member 113 is moved rightward together with the lever 114 against the biasing force of the coil spring 116, so that the biasing force of the coil spring 116 no more acts on the movable gear 112. As a result, the movable gear 112 receives the biasing force of the coil spring 115 so as to move rightward, and consequently the movable gear 112 disengages from the large-diameter portion 88A of the idle gear 88, in other words, meshing of the movable gear 112 and the large-diameter portion 88A of the idle gear 88 is released. In this instance, the drive force of the feed motor 44 is not transmitted to the sheet supply shaft 28. Hereinafter, the state of the second switching mechanism 110 shown in FIG. 10B, namely, the state in which meshing of the movable gear 112 and the large-diameter portion 88A of the idle gear 88 is released, is referred to as the fourth state.

That is, the second switching mechanism 110 is configured to be placed selectively in one of the third state in which the rotation of the sheet discharge shaft 57 is transmitted to the sheet supply shaft 28 and the fourth state in which the rotation of the sheet discharge shaft 57 is not transmitted to the sheet supply shaft 28. The second switching mechanism 110 is configured such that the state thereof is changed from the third state to the fourth state when the carriage 40 reaches the second position 32 and such that the state is changed from the fourth state to the third state when the carriage 40 moves from the second position 32 in the leftward direction. In other words, the second switching mechanism 110 is configured to be placed in the third state when the carriage 40 is located in the image recording region (such as when an image is being recorded on the recording sheet) and is configured to be placed in the fourth state only when the carriage 40 reaches the second position 32. In this respect, reaching of the carriage 40 to the second position 32 includes not only stopping of the carriage 40 at the second position 32, but also moving of the carriage 40 further in the rightward direction from the second position 32.

As shown in FIG. 3, both of the first position 31 and the second position 32 are located outside the image recording region, namely, located on one of opposite sides of the image recording region in the left-right direction 9 (on the right side in FIG. 3). Further, the first position 31 is located more rightward than the second position 32, namely, located closer to a right-side end in the left-right direction 9, while the second position 32 is located more leftward than the first position 31, namely, located closer to a central side or a left-side end in the left-right direction 9. Accordingly, the carriage 40 that moves rightward in FIG. 3 surely or inevitably reaches the second position 32 before reaching the first position 31. In other words, the carriage 40 surely or inevitably permits the state of the second switching mechanism 110 to be changed from the third state to the fourth state before permitting the state of the first switching mechanism 100 to be changed from the second state to the first state. On the other hand, the carriage 40 that moves leftward in FIG. 3 from the first position 31 surely or inevitably permits the state of the first switching mechanism 100 to be changed from the first state to the second state before permitting the state of the second switching mechanism 110 to be changed from the fourth state to the third state.

In the arrangement described above, where the carriage 40 is located in the image recording region, the drive force of the feed motor 44 is transmitted to only the sheet supply shaft 28 not to the pump 72, so that the recording sheet is supplied from the sheet supply tray 20. On the other hand, where the carriage 40 reaches the first position 31, the drive force of the feed motor 44 is transmitted only to the pump 72 not to the sheet supply shaft 28, so that the purging operation is performed on the carriage 40 located at the first position 31.

The first position 31 and the second position 32 may be mutually the same in the left-right direction 9. In this instance, when the carriage 40 reaches the first position 31 (the second position 32), the state of the second switching mechanism 110 is changed from the third state to the fourth state at the same time when the state of the first switching mechanism 100 is changed from the second state to the first state. Further, when the carriage 40 moves from the first position 31 (the second position 32) in the leftward direction, the state of the second switching mechanism 110 is changed from the fourth state to the third state at the same time when the state of the first switching mechanism 100 is changed from the first state to the second state. That is, the first position 31 and the second position 32 should have a positional relationship that inhibits the first switching mechanism 100 and the second switching mechanism 110 from being placed in the first state and the third state, respectively, at the same time.

Advantageous Effects of the Invention

According to the present embodiment, the rotation of the sheet feed shaft 56 generated by the drive force of the feed motor 44 is transmitted to the sheet supply shaft 28 via the sheet discharge shaft 57. Consequently, for instance, the feed roller 60 does not undergo directly an influence of a change in the rotational torque of the sheet supply roller 25, e.g., an influence of a reduction in the rotational torque due to passing of the trailing end of the recording sheet through the sheet supply roller 25, for instance. Thus, the load in the force transmission path is distributed. Moreover, the switching mechanism can be simplified or eliminated by reducing a transmitting mechanism connected to the sheet feed shaft 56, for instance. Thus, the mechanism for transmitting the force can be simplified.

In the present embodiment, the first transmitting mechanism 80 is provided on one of the opposite sides in the left-right direction 9 while the second transmitting mechanism 85 is provided on the other of the opposite sides in the left-right direction 9, so that the components of the first transmitting mechanism 80 and the components of the second transmitting mechanism 85 do not interfere with one another. Accordingly, the structure of each transmitting mechanism can be simplified, and the size of the apparatus in the left-right direction 9 can be reduced. It is noted, however, the layout of the first transmitting mechanism 80 and the second transmitting mechanism 85 are not limited to those illustrated above. That is, both of the first transmitting mechanism 80 and the second transmitting mechanism 85 may be disposed on the one of the opposite sides in the left-right direction 9, namely, may be disposed on the same side. The arrangement ensures a large space on the other of the opposite sides in the left-right direction 9.

In the present embodiment, transmission of the drive force from the feed motor 44 to the sheet feed shaft 56 and transmission of the drive force from the sheet feed shaft 56 to the sheet discharge shaft 57 are conducted at the end portion of the sheet feed shaft 56 on the same side in the left-right direction 9, ensuring smooth transmission of the drive force in a section of the force transmission path from the feed motor 44 to the discharge rollers 62. Further, it is possible to reduce the load that acts on various components for transmitting the drive force.

In the present embodiment, by employing the first transmitting mechanism 80 constituted by the first pulley 81, the second pulley 82, and the belt 83, the transmission efficiency of the drive force between the sheet feed shaft 56 and the sheet discharge shaft 57 is enhanced. Consequently, the feed roller 60 and the discharge rollers 62 can operate accurately in conjunction with one another, whereby the feeding or conveyance accuracy of the recording sheet is enhanced. On the other hand, by employing the second transmitting mechanism 85 constituted by the plurality of gears (i.e., the first gear 86, the second gear 87, the idle gears 88, 89, etc.) that are in mesh with one another, it is possible to generate a torque necessary for the sheet supply roller 25 to supply the recording sheet to the sheet feeing path 65.

Thus, it is possible to employ respective suitable force transmission ways for between the sheet feed shaft 56 and the sheet discharge shaft 57 and for between the sheet discharge shaft 57 and the sheet supply shaft 28. It is noted, however, that the structure of the first transmitting mechanism 80 and the structure of the second transmitting mechanism 85 are not limited to those illustrated above. For instance, the number of the gears that constitute the second transmitting mechanism 85 is not limited to two, but may be one or may be three or more. The transmission way of the drive force by the first transmitting mechanism 80 and the transmission way of the drive force by the second transmitting mechanism 85 may be mutually the same or may be mutually different. (Here, the transmission way of the drive force includes transmission by gears, transmission by a belt, or a combination thereof, for instance.) In other words, the first transmitting mechanism 80 may be constituted by a plurality of gears that are in mesh with one another. The second transmitting mechanism 85 may be constituted by a plurality of pulleys and at least one belt.

In the MFP 10 that employs the sheet supply tray 20 with a large capacity, the sheet supply shaft 28 tends to be disposed at a position distant from the sheet feed shaft 56, in other words, at a position close to the sheet discharge shaft 57. In view of this tendency, in the present embodiment, the second transmitting mechanism 85 for transmitting the drive force to the sheet supply shaft 28 is connected not to the sheet feed shaft 56, but to the sheet discharge shaft 57, whereby it is possible to restrain the second transmitting mechanism 85 from becoming large-sized and complicated. More specifically, the number of the components of the second transmitting mechanism 85 can be reduced in the present embodiment, as compared with a case in which the sheet feed shaft 56 and the sheet supply shaft 28 are connected by idle gears at the right-side end in FIG. 3.

Further, according to the present embodiment, the drive force of the feed motor 44 is not transmitted simultaneously to the sheet supply shaft 28 and the pump 72. In other words, owing to the first switching mechanism 100 and the second switching mechanism 110, the drive force of the feed motor 44 is transmitted selectively or exclusively to one of the sheet supply shaft 28 and the pump 72. Consequently, it is possible to prevent supply roller 25 from mistakenly supplying the recording sheet during the maintenance operation performed by the purging mechanism 70.

It is to be understood that the positional relationship, in the left-right direction 9, of each constituent element in the present embodiment is one example and is not limited to that illustrated above. That is, the "right" and the "left" in the above explanation may be read as one and the other in the left-right direction 9. This is true of the up-down direction 7 and the front-rear direction 8.

What is claimed is:

1. An image recording apparatus, comprising:

a sheet supply roller configured to supply a sheet to a sheet feeding path;

a sheet feed roller configured to feed the sheet supplied to the sheet feeding path by the sheet supply roller downstream in a sheet feeding direction in which the sheet is fed;

a discharge roller configured to discharge the sheet fed by the sheet feed roller downstream in the sheet feeding direction;

a drive motor configured to drive a first shaft for rotating the sheet feed roller;

a first transmitting mechanism configured to transmit a rotary motion of the first shaft to a second shaft for rotating the discharge roller;

a second transmitting mechanism configured to transmit a rotary motion of the second shaft to a third shaft for rotating the sheet supply roller;

a carriage disposed between the sheet feed roller and the discharge roller in the sheet feeding direction and configured to reciprocate in a width direction orthogonal to the sheet feeding direction;

a recording head mounted on the carriage and configured to eject ink from nozzles to the sheet that is being fed in the sheet feeding path; and a first switching mechanism configured to be placed selectively in one of a first state in which the rotary motion of the second shaft is transmitted to the third shaft and a second state in which the rotary motion of the second shaft is not transmitted to the third shaft.

2. The image recording apparatus according to claim 1, further comprising:

a maintenance portion configured to be driven by the rotation of the first shaft transmitted thereto so as to perform maintenance of the nozzles of the recording head;

a second switching mechanism configured to be placed selectively in one of a third state in which the rotary motion of the first shaft is transmitted to the maintenance portion and a fourth state in which the rotary motion of the first shaft is not transmitted to the maintenance portion.

3. The image recording apparatus according to claim 2, wherein a state of the first switching mechanism and a state of the second switching mechanism are changed by a movement of the carriage in the width direction.

4. The image recording apparatus according to claim 3, wherein the first switching mechanism and the second switching mechanism are disposed at one of opposite sides of the sheet feeding path in the width direction, wherein the second switching mechanism is configured such that the state thereof is changed from the fourth state to the third state when the carriage reaches a first position in the width direction and such that the state is changed from the third state to the fourth state when the carriage moves from the first position toward a central side in the width direction, and wherein the first switching mechanism is configured such that the state thereof is changed from the first state to the second state when the carriage reaches a second position that is the same position in the width direction as the first position or that is a position which is closer to the central side in the width direction than the first position and such that the state is changed from the second state to the first state when the carriage moves from the second position toward the central side in the width direction.

* * * * *